US005894926A

United States Patent [19]

Stafford

[11] Patent Number: 5,894,926

[45] Date of Patent: Apr. 20, 1999

[54] NON-SPILL LIQUID TOOTHPASTE DISPENSER WITH SIMPLIFIED LIQUID CARTRIDGE

[76] Inventor: Bryan Wynn Stafford, 5109 Bayouside Dr., Chauvin, La. 70344

[21] Appl. No.: 08/995,187

[22] Filed: Dec. 22, 1997

[51] Int. Cl.[6] ..... B65D 77/04; A47B 88/00; A46B 17/00

[52] U.S. Cl. ..... 206/362.2; 132/308; 132/314; 206/581; 312/207

[58] Field of Search ..... 206/361, 362.2, 206/362.3, 581; 312/207; 132/308–311, 314, 324, 325; 222/93

[56] References Cited

U.S. PATENT DOCUMENTS

| | | | |
|---|---|---|---|
| 1,780,757 | 11/1930 | Lawson, Sr. et al. | 132/310 |
| 2,601,244 | 6/1952 | Boulicault | 132/309 |
| 4,827,951 | 5/1989 | Grussmark | 132/314 |
| 4,934,389 | 6/1990 | Pettiford | 132/325 |
| 5,348,028 | 9/1994 | Gustavel | 132/309 |
| 5,415,187 | 5/1995 | Heneveld | 132/325 |
| 5,501,340 | 3/1996 | Stafford | 206/361 |
| 5,544,754 | 8/1996 | Stahl | 206/581 |
| 5,629,577 | 5/1997 | Levitt et al. | 206/581 X |

*Primary Examiner*—Bryon P. Gehman
*Attorney, Agent, or Firm*—Monty Koslover Assoc.

[57] ABSTRACT

A modification of an earlier invention by this inventor for a non-spillable liquid toothpaste dispenser, to simplify its construction and make replacement liquid toothpaste cartridges more available. The dispenser stands upright for normal use, but can be used in any orientation. It is made of rigid plastic and comprises a case, a cap, a cartridge containing liquid toothpaste, a case stand and a tooth floss holder. Inside the case top is a novel sliding valve that utilizes semicircular doors at its top. In use, a toothbrush head is pushed through a flanged hole in the top of the case, through the valve semicircular doors and into the liquid toothpaste. When the toothbrush is withdrawn, excess toothpaste is wiped off by the doors which return to their normal closed position to seal off liquid flows A plug which fits tightly in the case top entry flange, is provided in the cap to ensure no liquid leakage when the dispenser is packed. The liquid cartridge is simple and inexpensive to replace.

1 Claim, 7 Drawing Sheets

NON-SPILL LIQUID TOOTHPASTE DISPENSER WITH SIMPLIFIED LIQUID CARTRIDGE

BACKGROUND OF THE INVENTION

1. Field of the Invention

This invention relates to toiletry devices and particularly to devices for dispensing toothpaste.

2. Background

U.S. Pat. No. 5,501,340 issued to the present inventor, describes a non-spillable liquid toothpaste dispenser. The dispenser stands upright for normal use and comprises a case, a cap portion and a cartridge containing liquid toothpaste. The cartridge is contained inside the case and incorporates a sliding valve having semicircular doors at its top. A compartment is provided for storing a toothbrush inside the case alongside the cartridges. The liquid contained in the cartridge can not leak through the valve doors when they are closed, and the cap when in place provides a further block to any leakage.

In use, after removing the cap from the top of the case, a toothbrush head is inserted through a flanged hole in the case top, through the valve semicircular doors and into the liquid in the cartridges. The brush head is then withdrawn and the valve doors close.

The device described above has been found to work very well and appears to be generally accepted by users. However, it is evident that significant design changes are needed to obtain wider user acceptance.

For refilling the device, provision was made for either refilling the empty cartridge through the valve in its top or replacing the empty cartridge with a filled cartridge. In practice, the empty cartridge is usually refilled rather than replacing it with a filled replacement cartridge. This is because a replacement filled cartridge is relatively expensive to provide, due to its complex construction and including a sliding valve. Another reason is that the particular shape of the cartridge eliminates the possible use of all cartridges except one made specifically with all the correct grooves, extending parts and a valve that are identical with the original cartridge. Clearly, there is a need to modify the dispenser to provide a simplified cartridge that is inexpensive and more readily replaceable, while maintaining the advantages of the sliding valve in the dispenser for preventing liquid leakage.

SUMMARY OF THE INVENTION

The invention comprises five separate molded plastic components: a long rectangular section hollow body or case that includes a novel sliding valve assembly fastened inside the case at its top, a top cap which fits over the case top at one end, a tubular cartridge containing liquid toothpaste that fits inside the case, a dental floss container and a case stand which fits into the bottom of the case, holding the dental floss container and the cartridge above it in place.

Provision is made for storing a toothbrush inside the case. In use, the device cap is removed and a toothbrush head is pushed through the sliding valve into the liquid toothpaste in the cartridge. When the toothbrush is pulled out, excess liquid is wiped off automatically and the valve closes, sealing in the liquid. A plug located inside the cap, mates with an opening in the valve top and provides additional liquid sealing.

The dispenser normally stands upright on its case stand legs. However, it can be used satisfactorily in any orientation. Refilling is done by either replacing the empty cartridge with a filled replacement or by pouring from a liquid toothpaste supply through the valve opening in the top of the dispenser case.

An invention advantage is that there is no likelihood and little possibility of liquid toothpaste leakage when the dispenser is packed and during air travel.

Another advantage is that a replacement liquid cartridge fitting the device is simply constructed so that it is far less expensive than that required for the original design dispenser, and also therefore more universally available.

Accordingly, it is an object of this invention to provide a liquid toothpaste dispenser incorporating a simply constructed liquid toothpaste cartridge that is easily replaced and is low in cost.

Another object of this invention to provide a liquid toothpaste dispenser that will not accidentally leak or spill liquid toothpaste in normal use or when placed in storage.

Further objects and advantages of the invention will be apparent from studying the following portion of the specification, the claims and the attached drawings.

DESCRIPTION OF THE PREFERRED EMBODIMENT

Figure 1:
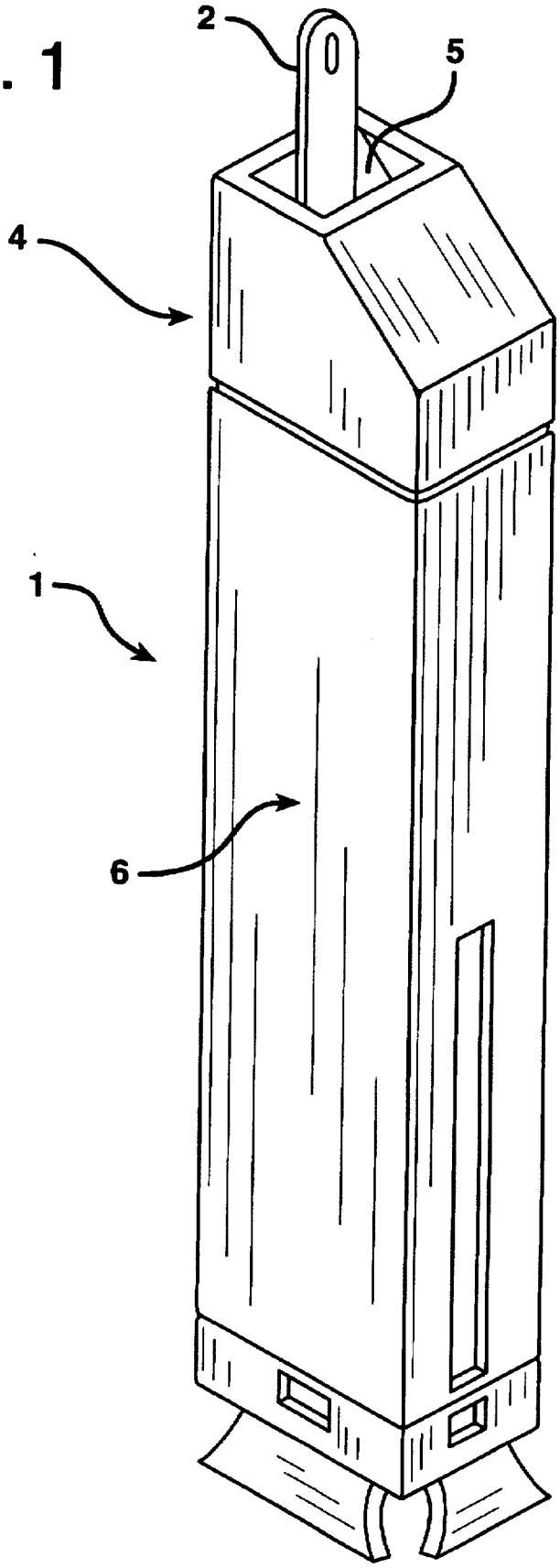
FIG. 1 is a front perspective view of the invention liquid toothpaste dispenser, particularly showing part of a toothbrush handle protruding as the toothbrush is being placed in a storage cavity in the dispenser.

Referring particularly to the drawings, there is shown in FIG. 1 a perspective view of a liquid toothpaste dispenser 1 according to the present invention. This dispenser 1 contains a liquid toothpaste cartridge and a dental floss dispenser, provides convenient storage for a toothbrush and includes a valve preventing accidental spillage of the liquid toothpaste while in normal use or while the device is in storage.

Referring to FIG. 1, a toothbrush 2 is shown being either placed inside the dispenser 1 or being removed from the dispenser 1. A flap 5 in the dispenser cap 4 allows a toothbrush to be inserted in the dispenser case 6 for storage without removing the cap 4.

Figure 2:
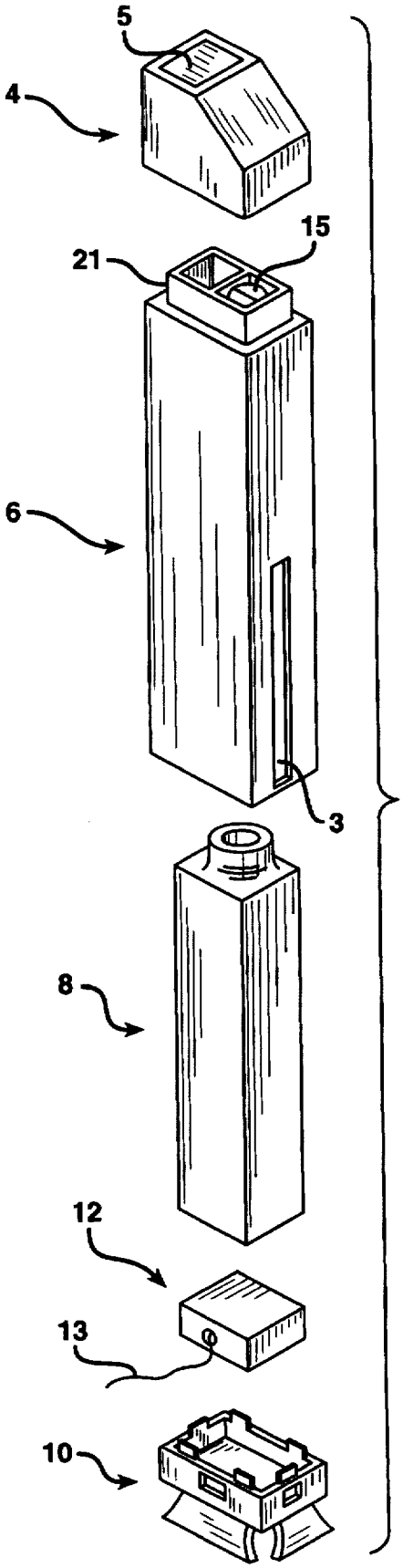
FIG. 2 is an exploded view of the invention liquid toothpaste dispenser, showing in perspective a dispenser cap, a case, a liquid toothpaste cartridge, a dental floss container and a bottom case stand.

The five major parts of the dispenser assembly are shown in the exploded view of FIG. 2. These are, from the top down, a dispenser cap 4, a case 6, a cartridge 8, a dental floss container 12 and a case stand 10. All the parts are made from molded plastic.

The case 6 is an elongated, rectangular cross-section, four sided box which is open at both ends. At the top end, a stepped, flange projecting portion 21 narrows the opening and is divided it into two square openings. These square openings provide access to a toothbrush storage enclosure 22 and to a valve and cartridge enclosure through a circular flange 15.

Figure 8:
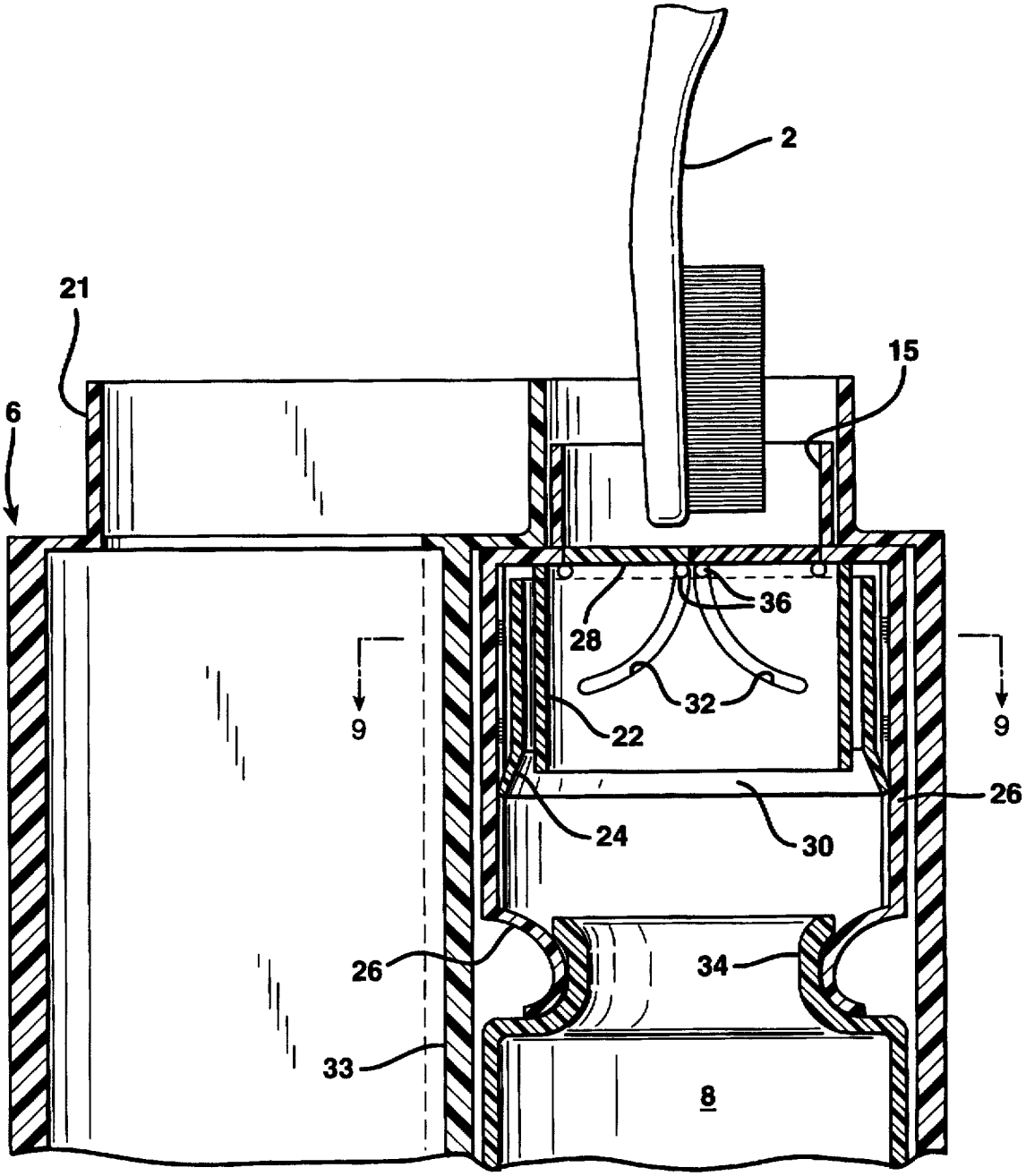
FIG. 8 is a partial, cross-section side elevation view of assembled device, without the dispenser cap, particularly showing the liquid toothpaste cartridge located inside the case and a sliding valve assembly mechanism located above the cartridge.
Figure 9:
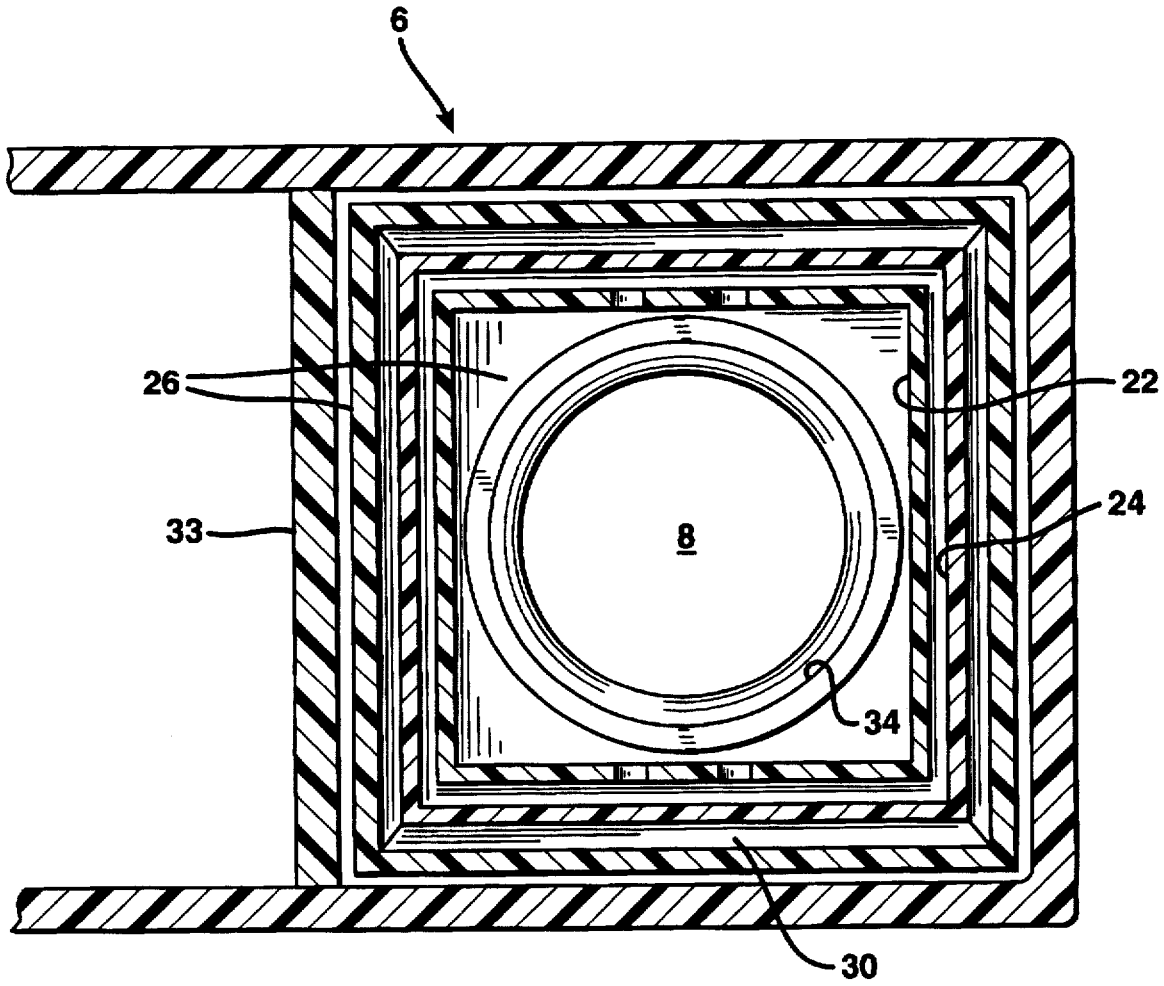
FIG. 9 is a partial, top cross-section view of the case and sliding valve assembly taken along line 9—9 of FIG. 8, and useful in explaining the nesting construction of the sliding valve inside the case.
Figure 10:
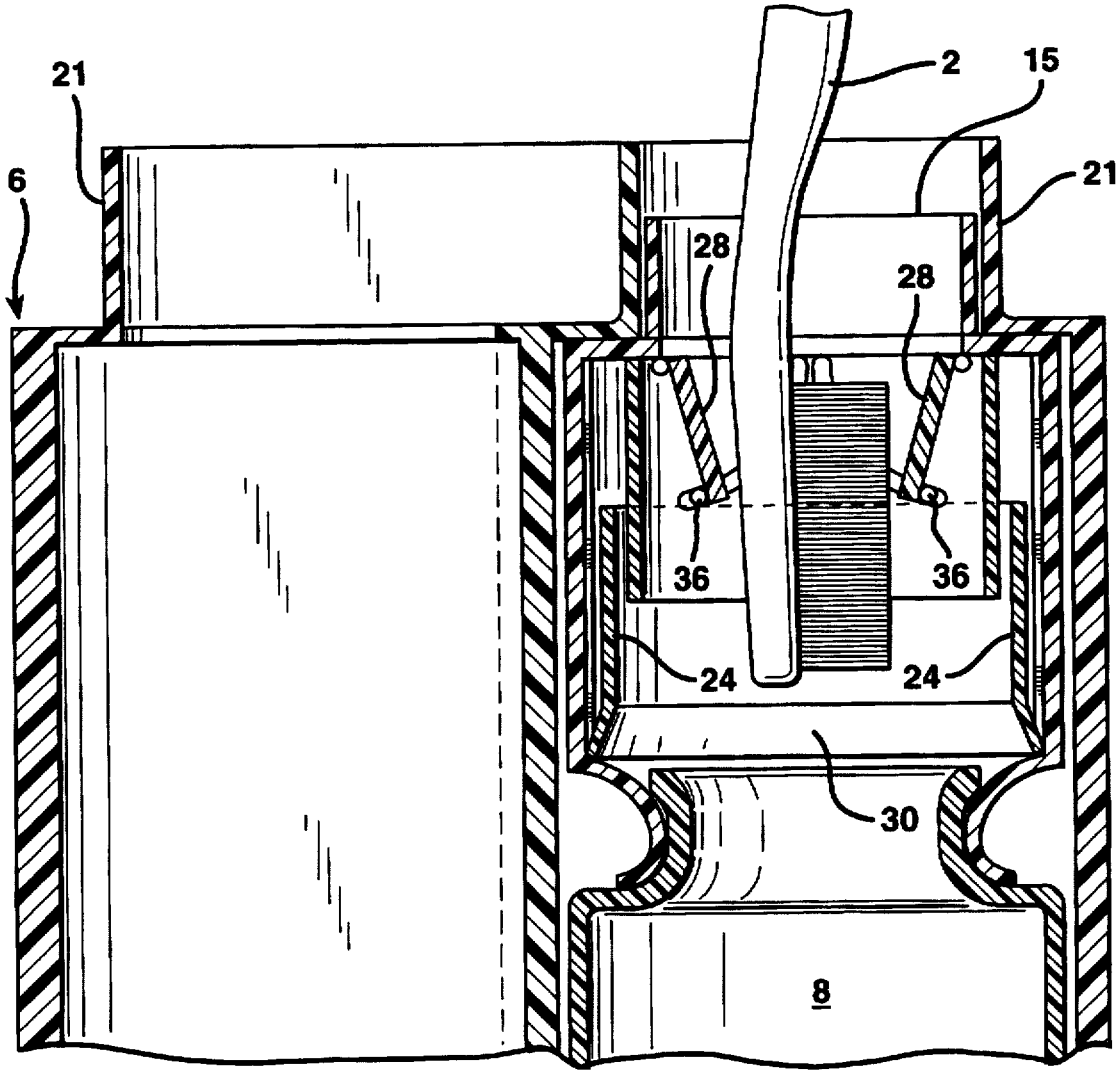
FIG. 10 is a partial, cross-section side elevation view of the assembled device, particularly showing how a toothbrush is pushed through the sliding valve doors and into the liquid toothpaste cartridge, the valve doors being opened and the valve slider sleeve pushed down by the doors rotating movement.

On the lower part of one of the case narrow sides, an elongated slot 3 is cut. This slot 3 is for the purpose of viewing the level of liquid toothpaste in the cartridge 8. Fastened inside the case at the top of the valve and cartridge enclosure is a novel sliding valve assembly which is illustrated in FIGS. 8, 9 and 10.

The cartridge 8 is a plastic tube having a clear, translucent portion for at least half the length and having an approximate square cross-section. The cartridge is sealed at one end bottom end has a wide, circular flanged opening at its distal top end. This cartridge opening is made wide enough to permit insertion of a toothbrush head through the opening and into liquid toothpaste which is stored in the cartridge 8.

The dental floss container 12 is rectangular in shape, and includes a hole with a cutting edge in its side through which to pull stored dental floss 13. The container 12 is sized to fit in the top of the case stand 10 when the device is assembled.

Figure 3:
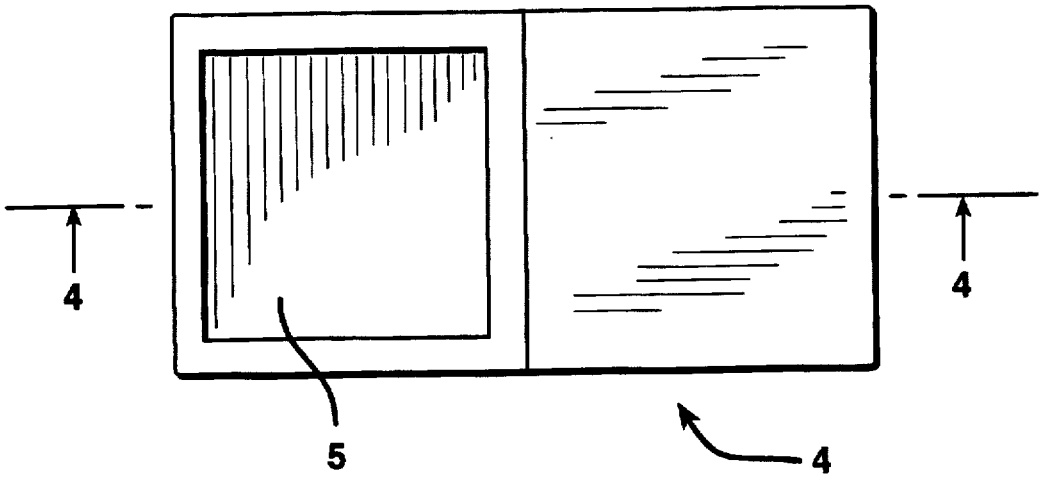
FIG. 3 is a plan view of the dispenser cap.
Figure 4:
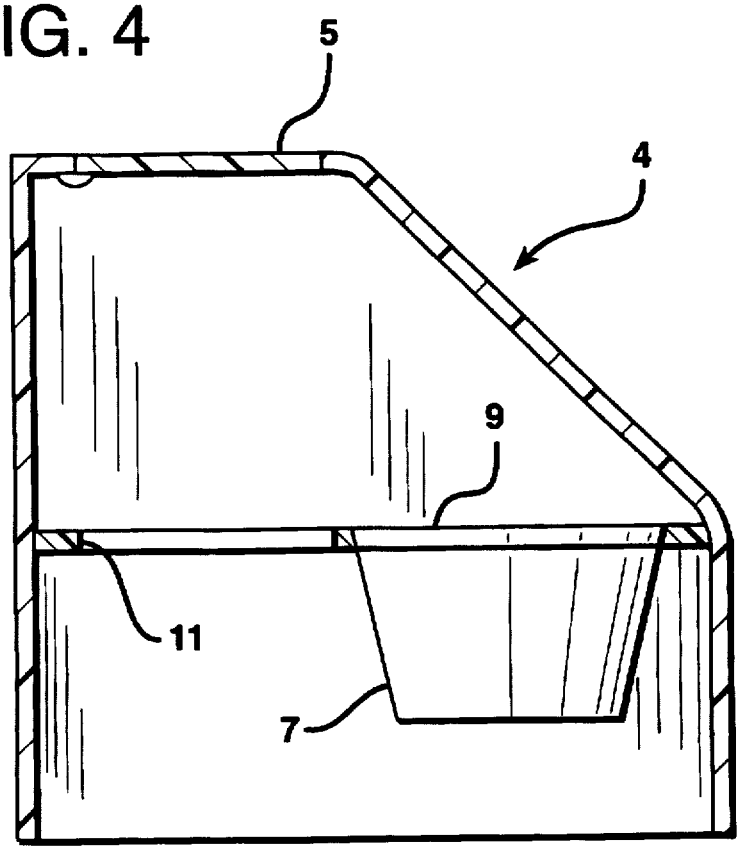
FIG. 4 is a side elevation cross-section view of the dispenser cap taken line 4—4 of FIG. 3, and particularly showing the location and shape of a plug which is used to seal the top of the cartridge.
Figure 5:
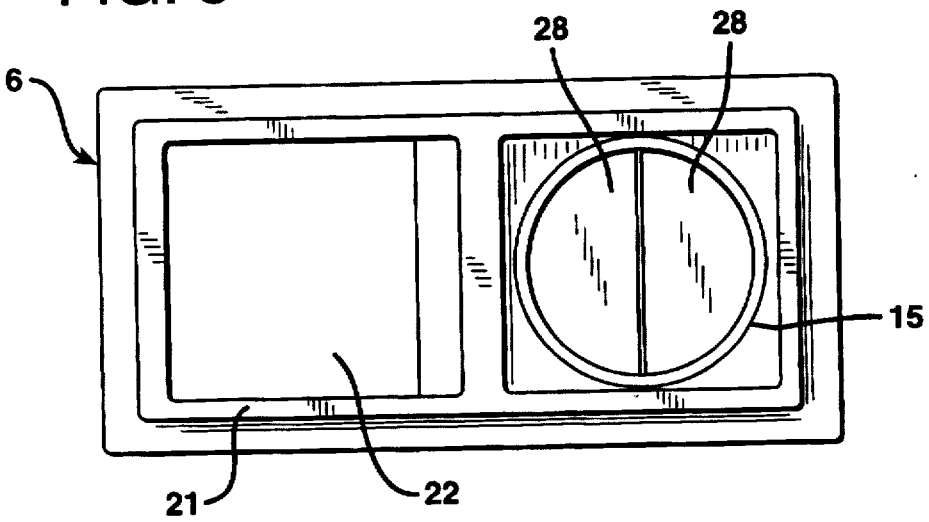
FIG. 5 is a top plan view of the case, particularly showing the location of the sliding valve semicircular doors through which a toothbrush head may be inserted.

Refer to FIGS. 3, 4 and 5 which are respectively, a top plan of the dispenser cap 4, a side elevation cross-section view of the dispenser cap 4 and a top plan view of the dispenser case 6. The cap 4 is a box having one open side which is shaped and sized to fit snugly over the top projecting portion 21 of the case 6. Inside the cap 4, across its lower portion, is a support shelf 9. In one part of the shelf 9, directly under the top flap 5 is a rectangular hole 11 which is about the same size as the flap 5. The rectangular hole allows a toothbrush to be passed through it and into the case storage cavity 22.

Suspended attached to the other half of the shelf 9 is a plug 7 which is located, shaped and sized to fit snugly into the flanged opening 15 portion of the valve assembly, sealing it from any leakage that may come through partially open valve doors 28.

Figure 6:
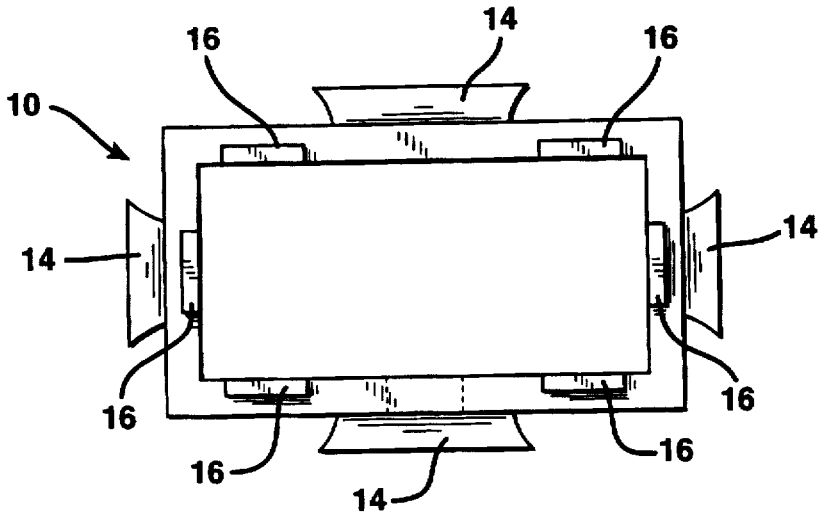
FIG. 6 is a top plan view of the case stand.
Figure 7:
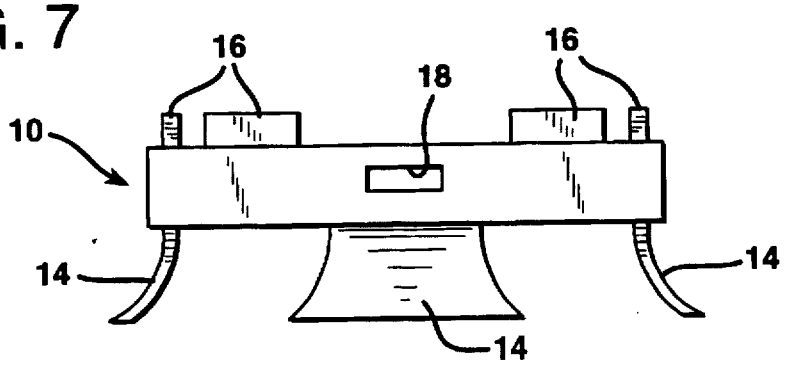
FIG. 7 is a side elevation view of the case stand.

Referring now to FIGS. 6 and 7, there is shown a top plan of the case stand 10 in FIG. 6 and a side elevation view of the stand 10 in FIG. 7. The stand 10 is molded as a rectangular shaped tray, having four legs 14 projecting below its outer periphery, and a number of upwards projecting tabs 16 which are located, set back from the outside edge on top of the walls surrounding the stand. The stand 10 length and width dimensions are sized so that the tabs 16 will fit inside the bottom of the case 6, bearing snugly against the inside surface of the case 6 walls while the case 6 rests on top of the stand 10.

One or more slotted holes 18 are located around the sides of the stand 10 to provide an exit for the dental floss 13 in its case 12 when the dental floss case 12 has been placed in the stand 10.

Refer to FIGS. 8, 9 and 10 which particularly show detail of the sliding valve assembly construction inside a partial, cutaway view of an assembled dispenser with its top cap 4 removed. In FIGS. 8 and 10 the sliding valve assembly is shown exaggerated in size proportionally, for the sake of clarity and ease of understanding In FIG. 8, the neck 34 of the liquid toothpaste cartridge 8 is shown as it would be grasped by the flexible, curved bottom seals of the valve assembly This ensures that liquid flow is contained by the valve. The valve doors 28 are closed prior to pushing the head of a toothbrush 2 down through them.

The sliding valve assembly comprises a valve top portion, a valve support enclosure 22, a sliding sleeve 24, and an outer sleeve seal 26. In addition, a circular flange 15 is mounted and fastened to the top surface of the valve top portion.

The valve top portion is an approximately square piece of plastic sheet that is sized to fit inside the case 6 and is adhered to the case 6 top at he top of the cartridge enclosure. Two valve doors 28 are mounted to a circular hole located in the center of the valve top portion directly under the circular flange 15. The doors 28 are two halves of a plastic disk which pivot on a plastic hinge means at the door circumference, attached to the valve top portion The valve support enclosure 22 is a square box, open at both ends, having an inside width large enough to fit around the valve doors, and fastened at its upper end to the bottom surface of the valve top portion, fixing it in place directly under the valve doors 28. The enclosure 22 also includes means which cooperate with the valve doors 28 and the sliding sleeve 24 to cause the valve doors to swing closed. Attached to the valve doors 28 underside and along the straight edge of each door 28 is a plastic pin 36 which projects outward and through curved slots 32 which are cut into the support enclosure 22. The pin 36 ends protruding through the slots 32 bear on the top edge of the sliding sleeve 24 which surrounds the support enclosure 22, pushing the sliding sleeve 24 downwards when the doors 28 are pushed and rotated open as shown in FIG. 10, or pushing the doors closed when the sliding sleeve 24 is moved upward.

The sliding sleeve 24 is square shaped and fits closely around the valve support enclosure 22. The lower end of the sliding sleeve 24 is flared outwards 30 to act as a barrier for liquid flow and to apply upward pressure on the sleeve when liquid impinges on its inner surface. The flared portion 30 functions in the following manner: When the dispenser is turned at an angle so that the internal liquid toothpaste flows toward the top of the dispenser, the viscous liquid toothpaste flow will then impinge on the flared sleeve portion 30 and push the sliding sleeve 24 upwards, closing the valve doors 28. In practice, the door 28 hinges have been found to be somewhat elastic, so that the doors will probably close even without being pushed to close by the sliding sleeve 24.

An outer sealing sleeve 26 fits around the sliding sleeve 24 and is fastened at its top edge to the bottom surface of valve top portion. This sealing sleeve 26 allows for vertical up and down movement of the sliding sleeve 24 while bearing against the lower flared portion of the sleeve as it moves. The outer sealing sleeve also provides a tight seal around the open neck 34 of the cartridge 8, preventing any liquid toothpaste leakage.

An inner dividing wall 33 in the case 6 may be provided as an aid to holding the cartridge 8 in place, but a continuous wall from top to bottom is not deemed necessary. The dividing wall 33 length need be made only long enough to enclose the valve assembly as shown in FIGS. 9 and 10 and a part of the cartridge 8 beneath it.

As described above, the valve is simple in concept, utilizing no springs and depending primarily on the elasticity of the plastic hinges, with a backup provided by a sliding sleeve actuated by liquid toothpaste flow. By itself, the valve door closure will prevent any leakage of the viscous liquid toothpaste enclosed in the cartridge and the valve assembly. However, the dispenser cap plug which mates with an orifice in the flange on top of the valve provides further safety against leakages making leakage under any circumstances highly unlikely.

The method of applying the toothpaste to the toothbrush is convenient to use. This is done by dipping a brush into the top of the dispenser and into the liquid pool, withdrawing the brush and having the valve doors wipe off the excess, with no drops spilled. This method avoids spillage as may occur with other conventional liquid toothpaste dispensers.

By moving the valve assembly, with some modification, from its earlier invention location inside the top of the cartridge to the inside top of dispenser case, a far simpler cartridge design has been made possible. The cartridge now has a simple rectangular section tube constructions so that refill cartridges may be supplied by anyone so long as the tube dimensions fit inside the case. It is therefore reasonable to expect that availability of the cartridges should be wider and their cost as replacements, much cheaper.

A dental floss dispenser was included a being a much asked for conveniences easily stored in the bottom of the dispenser case.

The dispenser is easily refillable, by either replacement of the cartridge or by refilling the cartridge from a liquid toothpaste supply. Finally, the dispenser is slim and can stand on a bathroom shelf, occupying little space and pleasing to look at.

From the above descriptions it is clear that the preferred embodiment achieves the objects of the present invention. Alternative embodiments and various modifications may be apparent to those skilled in the art. These alternatives and modifications are considered to be within the spirit and scope of the present invention.

Having described the invention, what is claimed is:

1. A liquid toothpaste dispenser device including:

a cartridge contained therein made of molded, plastic transparent material and having a tubular shape; said cart with liquid toothpaste: said cartridge including a projecting circular top flange mounted at its open end; and, means for a door access valve which is located at the top of said dispenser device, permitting access by a toothbrush head to said liquid toothpaste and preventing leakage when not in uses said means including a sliding valve assembly comprising:

a support enclosure, said support enclosure being a square plastic box open at its bottom end; an enclosure top portion extending over the box sides forming a ledge around the periphery of said box, said enclosure top portion having two semicircular doors cut in its center forming a circular opening, said doors being mounted on plastic hinges to said enclosure top portion at their peripheral edges; two opposing enclosure sides including two curved slots each in an arc of approximately 90 degrees, said slots being located to trace the motion of the extreme ends of the straight edges of said doors as the doors pivot open through a 90 degree arc; said doors including pins attached to the underside of their straight edges to protrude through said curved slots, projecting a little beyond the outer surface of said support enclosure;

a sliding sleeve, said sliding sleeve being a square plastic box open at both top and bottom ends and fitting slidingly over the sides of said support enclosure, said sliding sleeve including a flared skirt portion attached to the bottom of the sleeve straight sides; and an outer sleeve, said outer sleeve having a rigid upper portion and a flexible lower portion, said upper portion being a square plastic box open at both ends and fitting over said sliding sleeve so that the edges of said flared skirt portion impinge on the inside surface of said outer sleeve, said upper portion of said outer sleeve being attached by adhesive to the under surface of said enclosure top portion; said lower portion being attached to the bottom edge of said upper portion and forming an annular shaped opening, said annular shaped opening having flexible curved walls and being sized to permit insertion of the top flange of said cartridge while tightly gripping and sealing said cartridge, preventing liquid leakage;

said doors opening inwards when pushed, and said pins on said doors bearing on the top edges of said sliding sleeve, causing said sliding sleeve to slide downwards; said liquid toothpaste inside said cartridge moving towards the cartridge top when said dispenser device is tilted, and impinging on the flared skirt portion of said sliding sleeve, causing said sliding sleeve to move upwards thereby pushing said doors closed.

* * * * *